US005429567A

United States Patent [19]

Gerschefske et al.

[11] Patent Number: 5,429,567

[45] Date of Patent: Jul. 4, 1995

[54] CROSS-COUNTRY AND DOWNHILL SLALOM SKIING EXERCISE MACHINE

[75] Inventors: Kevin Gerschefske; Rick Byrd, both of Springfield; William C. Brazeal, Mansfield, all of Mo.

[73] Assignee: Stamina Products, Inc., Springfield, Mo.

[21] Appl. No.: 146,216

[22] Filed: Nov. 1, 1993

[51] Int. Cl.[6] ..... A63B 69/18

[52] U.S. Cl. ..... 482/70; 482/51; 482/71

[58] Field of Search ..... 482/51, 70, 71, 72, 482/73, 52, 53, 54

[56] References Cited

U.S. PATENT DOCUMENTS 4,813,667 3/1989 Watterson ..... 482/70

5,098,085 3/1992 Abboudi et al. ..... 482/70

FOREIGN PATENT DOCUMENTS 3936655 5/1991 Germany ..... 482/70

*Primary Examiner*—Lynne A. Reichard

*Attorney, Agent, or Firm*—Kokjer, Kircher, Bowman & Johnson

[57] ABSTRACT

An exercise machine has a-first track and handlebar assembly for simulation of cross-country skiing and a second track and handlebar assembly for simulation of downhill slalom skiing. The first track assembly has first and second elongate, parallel rails. A footpad engages each rail and is adapted to move along the length of its respective rail. A pair of handlebars are pivotally mounted at a location near one end of the first and second elongate rails. The second track has first and second arched rails. A platform is releasably mounted on said first and second arched rails and is adapted to move from one end of the rails to the other. A handlebar is provided for grasping during use of the platform for exercising. Resiliently flexible tension bands or chords are used to resist movement of both the first and second footpads and the platform.

3 Claims, 4 Drawing Sheets

CROSS-COUNTRY AND DOWNHILL SLALOM SKIING EXERCISE MACHINE

BACKGROUND OF THE INVENTION

1. Field of the Invention

The present invention relates in general to an exercise machine for simulating skiing. In particular, the present invention relates to an improved exercise machine which permits the user to simulate either slalom or cross-country type snow-skiing.

2. Description of the Related Art

Both downhill slalom and cross-country snow skiing are known to provide an excellent physical workout. However, due to geographical location, climate, etc., access to a skiing environment is often not available. Additionally, each form of skiing is substantially different, requiring different equipment and necessitating the use of different muscles. Additionally, for the amateur skier, proper physical training for either, nonetheless each, of these sports prior to engaging in their rigors is often an impossibility.

A number of attempts to provide an exercise machine designed to simulate snow skiing, particularly cross-country skiing, have been made. However, none of these have the ability to be easily converted between an exercise device for simulating cross-country skiing and a device for simulating downhill slalom skiing. Additionally, just as actual skiing conditions may vary, it is desirable to provide an exercise machine which simulates multiple types of skiing which may be adjusted to provide different levels of difficulty. The present invention meets these previously unfilled needs.

SUMMARY OF THE INVENTION

An overall object of the present invention is to provide an exercise machine which permits the user to simulate both cross-country skiing and downhill slalom skiing.

Another object of the present invention is to provide an exercise machine, capable of operating as a cross-country ski exerciser and a downhill slalom ski exerciser, which is easy to convert from one mode of operation to the other.

Still another object of the present invention is to provide a ski exercise machine having variable tension control to permit varying levels of difficulty of operation.

These and other objects are achieved by a physical exercising apparatus having first track and handlebar assemblies for permitting the user to simulate cross-country skiing and second track and handlebar assemblies for permitting the user to simulate downhill slalom skiing. For simulation of cross-country skiing, first and second substantially flat elongate parallel track members extend between first and second base members. The base members are disposed laterally with respect to the track members and interconnect the ends of the track members.

Each cross-country track has a footrest thereon adapted to slidingly engage its respective track. Each footrest may travel the length of its track independently of the other. Intermediate the two cross-country tracks are a first spool near one end of the exercise machine and a second spool located near the other end of the machine. An elastomeric band is wound around these spools to form an elongated loop. The elastomeric loop is threaded through a portion of each cross-country footrest such that movement of a footrest is against the resistance of the loop.

Each handlebar of a pair of upwardly extending handlebars for gripping by the left and right hand of the user, respectively, is pivotally mounted at one end of the exercise machine. The upper ends of the cross-country handlebars move back and forth independently of each other in the same general direction as the footrests move. Tightening or loosening a knob at the location of the handlebar pivot adjusts the tension, or resistance, of the handlebars.

For simulation of downhill slalom skiing, an arched track assembly is provided. Particularly, the arched track assembly is also comprised of a first track and a second track, each of which lies in a vertical plane parallel to the other, extending between the base members located at opposite ends of the exercise machine. The slalom downhill tracks are preferably each inwardly spaced from the cross-country tracks with the displacement between the tracks of the arched track assembly for downhill slalom exercising thereby being less than the displacement between the cross-country tracks. Each downhill slalom track is preferably comprised of a tube which begins at the base member at one end of the exercise machine and bows upwardly to substantially its middle and then curves back downwardly to meet the opposite base member.

A foot carriage having wheels for riding on the tubular slalom downhill tracks is placed on the tracks. A shock-absorbing platform upon which the user will stand during use is mounted on top of the carriage. It should be understood that when using the exercise machine of the present invention in the downhill slalom mode, the user stands sidewise with respect to his or her orientation when performing a cross-country exercise. A downhill slalom handlebar extends from one base member to the other in front of the user. Accordingly, during use, the user grasps the downhill slalom handlebar for balance while creating a side to side movement with the lower body such that the foot carriage rolls back and forth between one end of the slalom downhill track assembly and the other. Tension is created by tension cords attached at each end of the exercise machine and threaded through the carriage roller assembly. Tension is adjustable by altering the number of tension cords.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 2:
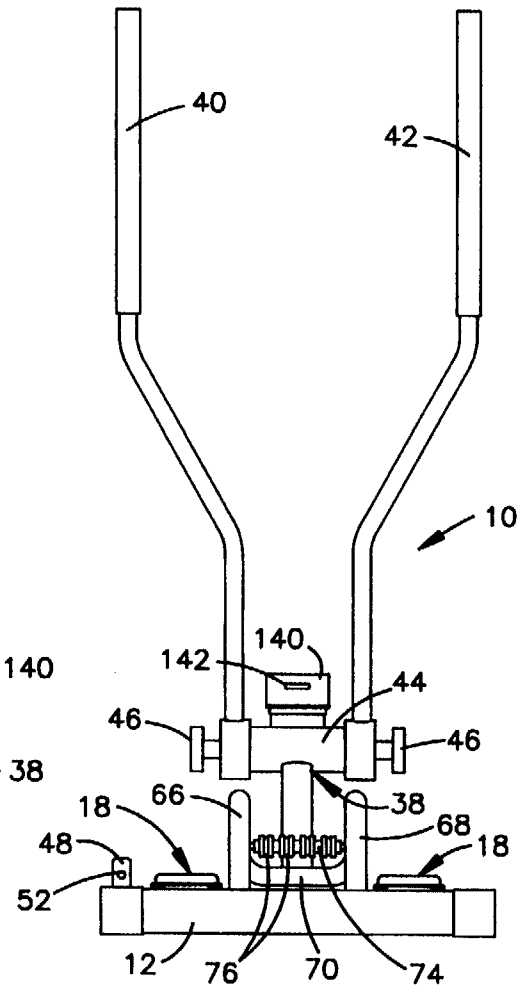
FIG. 2 is a left end view thereof.
Figure 1:
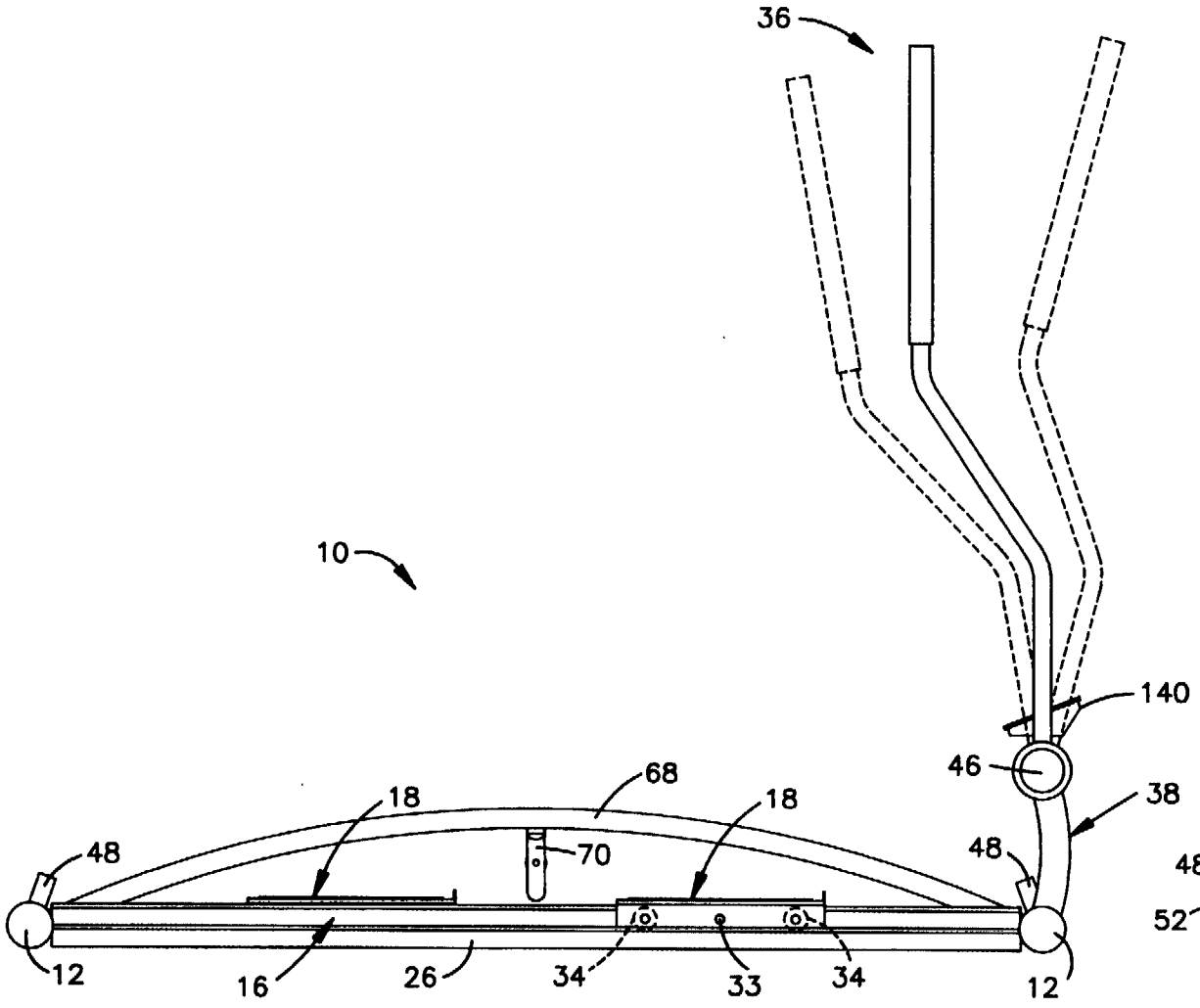
FIG. 1 is a front elevational view of the preferred embodiment of the exercising machine of the present invention adapted for use in cross-country mode.
Figure 3:
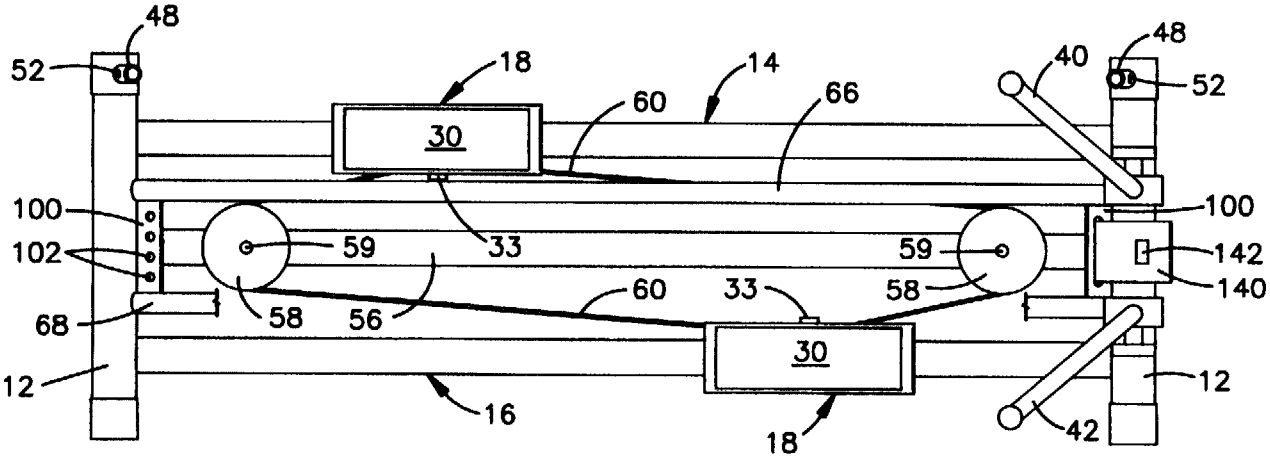
FIG. 3 is a top plan view thereof.

With reference initially to FIGS. 1–3, the preferred embodiment of the exercising machine of the present invention is denoted generally by reference numeral 10. As shown in FIGS. 1–3, exercise machine 10 is adapted for use in a cross-country ski mode.

The preferred embodiment of exercise machine 10 is comprised of a base member 12 located at each end of machine 10. First and second elongate rails 14 and 16 extend between base members 12. Each of first and second elongate rails 14 and 16 has thereon a footpad assembly 18 which is adapted to engage and move along its associated track 14, 16 during the performance of a cross-country skiing exercise.

Figure 7:
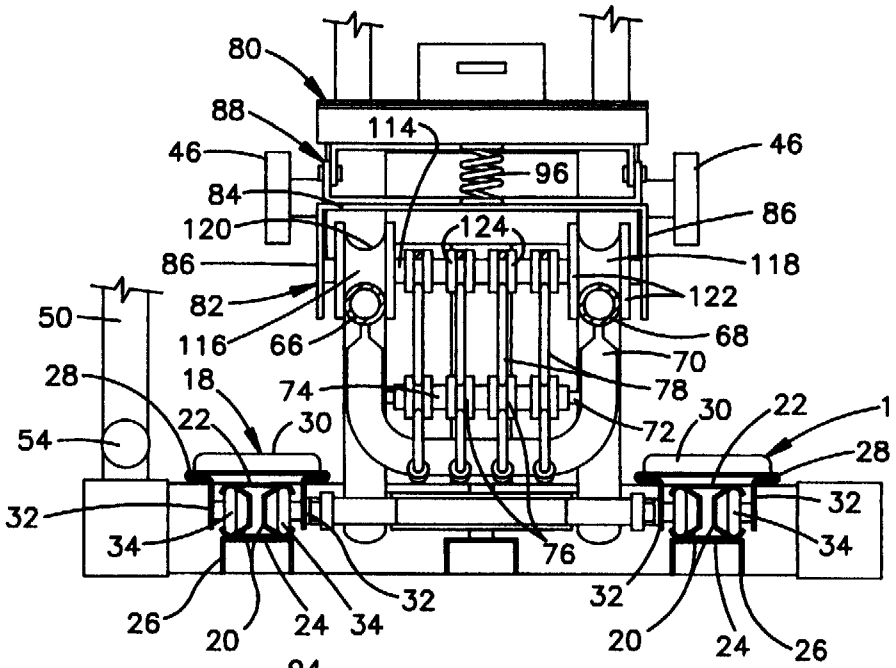
FIG. 7 is a cross-sectional view taken along line 7—7 of FIG. 4.

Each footpad assembly 18 comprises an upper surface upon which the foot rests during performance of the exercise and a sidewall extending downwardly from the upper surface along each side edge of its associated rail 14 or 16. More specifically, and as shown in FIG. 7, each rail 14, 16 preferably comprises substantially back-to-back C-shaped brackets 20 positioned between an upper rail member 22 and a lower rail member 24. Lower rail member 24 is located on rail support 26.

Each footpad assembly 18 is preferably comprised of a carriage assembly including an upper surface 28 having a footpad 30 located thereon. Footpad 30 preferably has a surface for providing traction to the user of machine 10. Flanges 32 extend downwardly from upper surface 28 along each side of rail 14, 16. Downwardly extending flanges 32 support wheels 34 which are received within the C-shaped brackets 20 located on each side of rails 14, 16. In this way, footpad assemblies 18 are adapted to roll along their respective rails while maintaining an engaged, retained relationship with the rail. It will be appreciated that the rail and carriage assembly combination could be constructed in a variety of manners.

A cross-country handlebar assembly 36 extends upwardly from one of the base members 12. In the preferred embodiment, cross-country handlebar assembly 36 comprises a T-shaped member 38 mounted at substantially a central location on one of the base members 12. Cross-country handlebars 40, 42 are pivotally mounted at each outer end of crossbar 44 of T-shaped member 38. Foam handgrips 39 are located on each handlebar 40, 42.

As shown in dashed lines in FIG. 1, cross-country handlebars 40, 42 may be moved back and forth in respective vertical planes, which are substantially parallel to vertical planes in which first and second elongate rails 14, 16 lie, by pivoting the cross-country handlebars 40, 42 about their pivotal mounting location on crossbar 44. Tensioning knobs 46 are located at the pivotal mounting location of each cross-country handlebar 40, 42 at the outer ends of crossbar 44. Appropriate rotation of tensioning knobs 46 will increase or decrease the resistance of movement of the cross-country handlebars 40, 42.

Figure 5:
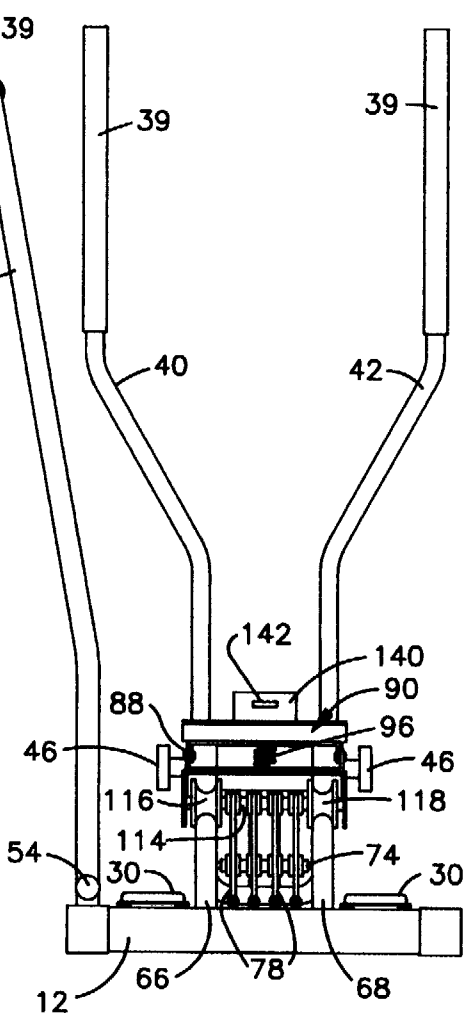
FIG. 5 is a left end view thereof.

With reference still to FIGS. 1 and 2, one mounting member 48 is located on each of the base members 12. These mounting members 48 are adapted to receive downhill ski/slalom handlebar assembly 50 (shown in FIGS. 4–6). As shown in FIG. 2, mounting members 48 have an aperture 52 therein. Downhill ski/slalom handlebar assembly 50 is preferably mounted on mounting members 52 in the following manner. Particularly, downhill ski/slalom handlebar assembly 50 has hollow ends which fit over respective mounting members 48. A pin or threaded screw 54 is then placed through each aperture near the ends of downhill ski/slalom handlebar assembly 50 and the aperture 52 in each of the mounted members 48 for holding the handlebar assembly 50 fixedly in place. Accordingly, it will appreciated that downhill ski/slalom handlebar assembly 50 may thereby be easily attached to or removed from the exercise machine 10 of the present invention. It should be understood that downhill ski/slalom handlebar assembly 50 could be constructed in a variety of manners. For instance, it is contemplated that a mechanism may be provided for tilting downhill ski/slalom handlebar assembly 50, at its lower ends, in such a manner so that the upper end of the assembly 50 is positioned away from the remainder of machine 10.

Figure 8:
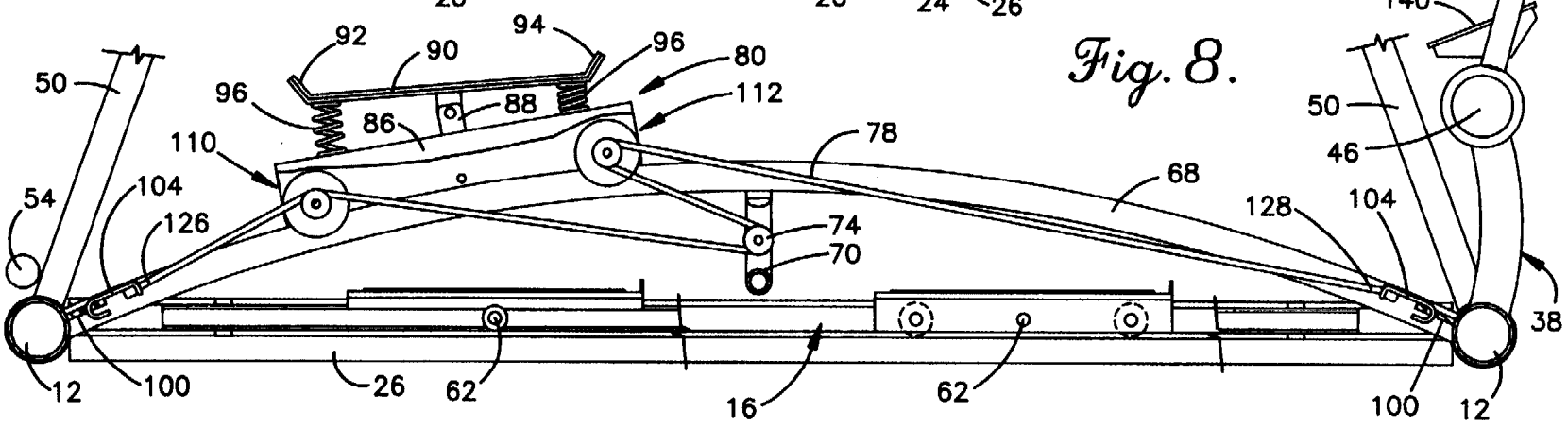
FIG. 8 is an enlarged front elevational view showing operation of the preferred embodiment of the present invention in downhill ski/slalom mode.

As shown in FIG. 3, a central base member 56 extends from substantially a central portion of one base member 12 to substantially a central portion of the other base member 12. First and second large spools 58 are mounted into the central base member 56 such that one large spool 58 is substantially near one end of the base member 56 and the other large spool 58 is substantially near the other end of central base member 56. It will be understood that spools 58 are mounted at approximately opposite ends of the overall frame of machine 10 and that the precise location and nature of their mounting may be varied. Large spools 58 are free to rotate about their central portion 59. Large spools 58 are preferably mounted such that they are oriented in a lateral relationship with respect to central base member 56. In this way, the large spools 58 are laterally disposed between first and second elongate rails 14, 16. A tensioning band 60 is wound around large spools 58. Additionally, the tensioning band 60 engages each foot pad assembly 18 for providing resistance to movement of the assemblies 18 along their respective elongate rails 14, 16. As shown in FIGS. 7 and 8, tensioning band 60 is attached to each of the foot pad assemblies 18 by a knob member 62 located on the interior-most downwardly extending flange 32 of foot pad assembly 18.

The resistance provided against movement of footpad assemblies 18 may be adjusted by altering the location at which tensioning band 60 is attached to the downwardly extending flanges 32 of foot pad assembly 18. Particularly, each knob 33 (See FIG. 7) engages with tensioning band 60 and may be releasably inserted into one of a plurality of apertures (not shown) formed in a row along the innermost downwardly extending flange 32 of each footpad assembly 18. It will be appreciated that tensioning band 60 may be engaged with foot pad assemblies 18 in a variety of manners. For instance, tensioning band 60 may be pinned to each of the foot pad assemblies 18. Alternatively, an eyelet, or a plurality of space 15 apart eyelets (not shown) may be provided on foot pad assemblies 18 such that the tensioning band 60 is merely threaded therethrough. Other arrangements will be apparent to those skilled in the art in view of this description.

Turning now to FIGS. 4–8, additional components and structure of the preferred embodiment of machine 10 are described. Particularly, components primarily utilized with the machine in downhill ski/slalom mode are described. Downhill ski/slalom track assembly 64 extends from one base member 12 to the other base member 12. Particularly, track assembly 64 is comprised of first and second arched track members 66, 68.

A U-shaped member 70 bridges arched tracks 66, 68 together beneath the arched tracks 66, 68 at substantially a central location thereof. An axle 72 extends between the upright members of the U-shaped bridge member 70. A collar 74 is axially mounted on axle 72. Particularly, collar 74 is a rotatable means having a plurality of spool-like regions 76 for engaging a plurality of tension chords 78.

A downhill ski/slalom carriage assembly 80 is positioned on downhill ski/slalom track assembly 64 and is adapted to roll back and forth from one end of the track assembly 64 to the other end of the track assembly 64. Particularly, downhill ski/slalom carriage assembly 80 is comprised of a base 82. Base 82 comprises an upper surface 84 and downwardly extending flanges 86 extending downwardly from upper surface 84 along the outer side edges of arched track members 66, 68. As shown best in FIGS. 7 and 8, first and second wheel assemblies 110, 112 are axially mounted between downwardly extending flanges 86. Particularly, as shown in FIG. 7 (showing one wheel assembly) each wheel assembly 110, 112 includes an axle 114 mounted between downwardly extending flanges 86. Each wheel assembly 110, 112 has associated therewith a first wheel 116 and a second wheel 118 for engaging respective arched track members 66, 68. As shown in FIG. 7, wheels 116, 118 are preferably constructed such that a recessed area 120 between the outer edges 122 of each wheel 116, 118 receives its associated track member 66 or 68. Each axle has thereon a plurality of spool-like regions 124 for guiding tension chords 78 used in accordance with the present invention. As shown in FIG. 8, first wheel assembly 110 is mounted at substantially a first end of said carriage assembly and second wheel assembly 112 is mounted at substantially a second end of said carriage assembly.

Figure 4:
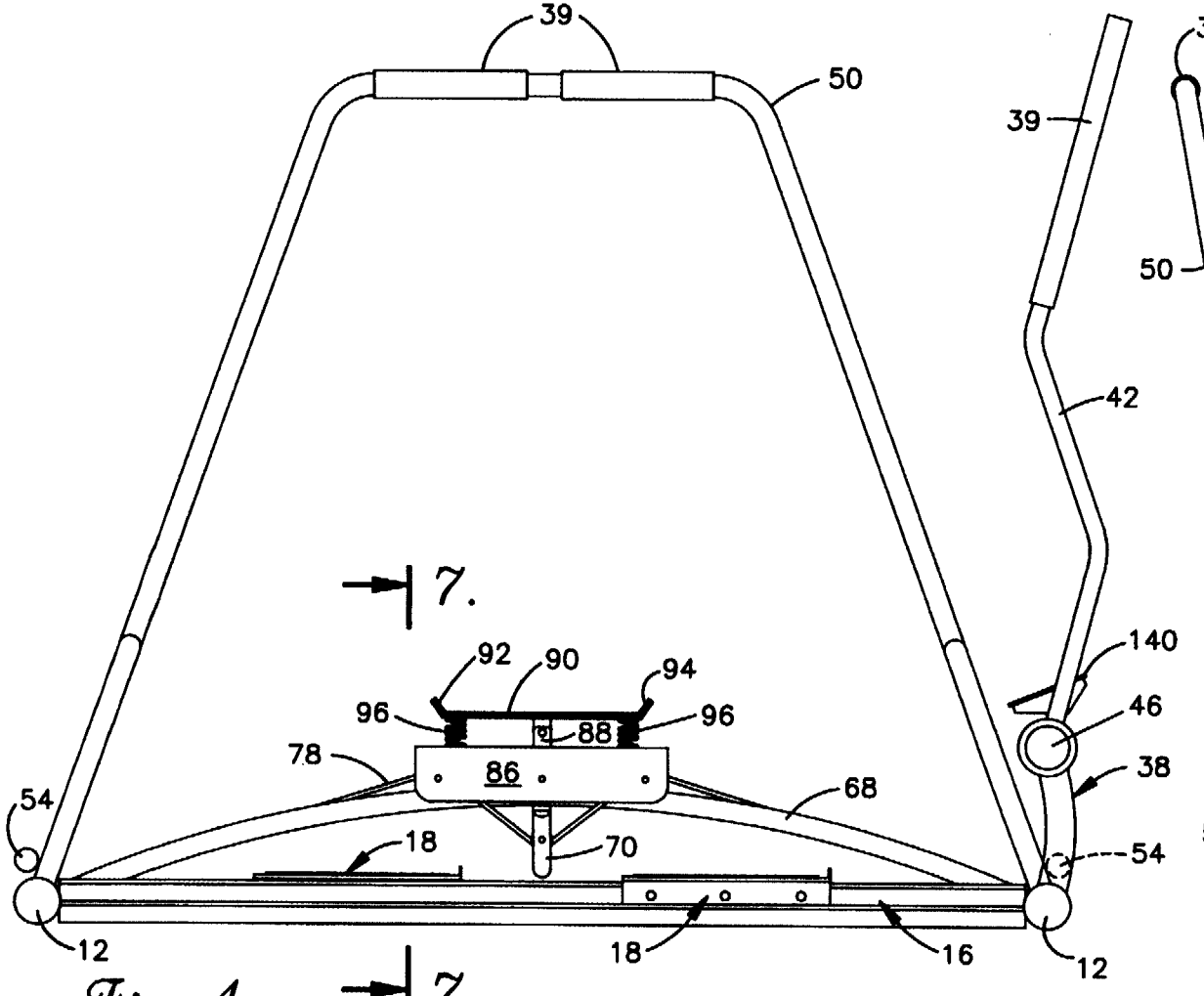
FIG. 4 is a front elevational view of the preferred embodiment of the exercising machine of the present invention adapted for use is downhill slalom mode.

A bracket assembly 88 mounted on upper surface 84 of base 82 of carriage assembly 80 supports a platform 90 upon which the user stands during use of machine 10 in a downhill ski/slalom mode. Platform 90 is comprised of a substantially flat plate having ends 92, 94 bent upwardly. It will be appreciated that such a configuration will assist in preventing the user's feet from sliding off of the carriage assembly 80 during use of machine 10 in a downhill ski/slalom mode. More specifically, bracket assembly 88 is located at substantially a central portion of upper surface 84 of carriage assembly 80 and additionally, at substantially a central portion beneath platform 90. Furthermore, bracket assembly 88 is adapted to toggle such that the outer ends 94 of platform 90 may be tilted with respect to bracket assembly 88 upon application of appropriate forces. As shown in FIG. 7, bracket assembly 88 extends laterally with respect to arched track members 66, 68. Shock absorbing springs 96 are positioned beneath the bottom surface of platform 90 and upper surface 84 of carriage assembly 80 as shown in FIG. 4. Preferably, one shock absorbing spring 96 is located beneath platform 90 at substantially the outer end of the flat portion of platform 90. As shown in FIG. 7, shock absorbing springs 96 are preferably mounted beneath platform 90 such that they are substantially centrally located with respect to arched track members 66, 68.

Figure 6:
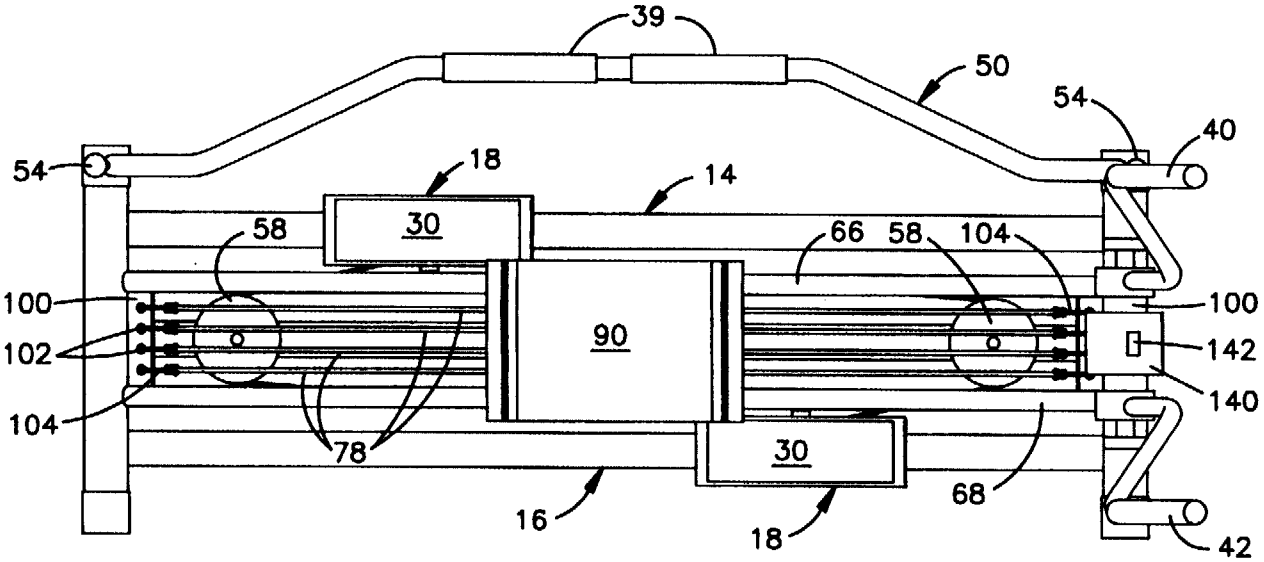
FIG. 6 is a top plan view thereof.

With reference now to FIGS. 6, 7, and 8, the tension chords 78 and their connection and positioning are described. Particularly, in accordance with the preferred principles of the present invention, at least one tensioning chord 78 stretches from a connecting point at each end of machine 10 and engages with the downhill ski/slalom carriage assembly 80 located on downhill ski/slalom track assembly 64. It will be appreciated that the tension chords 78 provide resistance to movement of the downhill ski/slalom carriage assembly 80 along track assembly 64. Additionally, in accordance with the principles of the present invention, resistance of motion of carriage assembly 80 is increased by adding additional tension chords 78. In the preferred embodiment, machine 10 may be operated with a minimum of zero chords 78 in place, and with a maximum of four chords 78 in place. It will be appreciated that other numbers of resistance chords may be used.

As shown in FIG. 6, a plate 100 is located on each base member 12 between the ends of arched track members 66, 68. Each plate 100 comprises a row of apertures 102. Each tension chord 78 includes a hook member 104 at each end thereof. Hook members 104 are adapted to be received by apertures 102 in plates 100. Accordingly, as shown in FIG. 6, a plurality of tension chords 78 having hook members 104 on the ends thereof are attached at each end to respective plates 100 located at opposite ends of machine 10, and thereby extend from one end of machine 10 to the other between arched track members 66, 68 and in engagement with the underside of downhill ski/slalom carriage assembly 80.

With reference now to FIGS. 7 and 8, the manner in which tension chords 78 engage carriage assembly 80 during operation of machine 10 in downhill ski/slalom mode is described in detail.

As shown in FIG. 8, downhill ski/slalom carriage assembly 80 has been rolled along downhill ski/slalom track assembly 64 from its starting position shown in FIG. 6. Initially, with reference to FIG. 8, the positioning of one tension chord 78 is described. It will be appreciated that additional tension chords 76 are utilized in a similar manner. Beginning at the left side of FIG. 8, hook member 104 at a first end 126 of tension chord 78 is hooked through an aperture 102 on plate 100. Tension chord 78 extends through said carriage assembly 80 in an engaging relationship therewith. Hook 104 at a second end 126 of tension chord 78 is hooked through an aperture 102 on plate 100 at the other end of machine 10.

More specifically, tension chord 78 is threaded through carriage assembly 80 such that it extends over axle 114 of a first wheel assembly 110, under bridge element 72, and over an axle 114 of second wheel assembly 112 of carriage assembly 80. Such an arrangement restrains carriage assembly 80 on arched track members 66, 68. Particularly, as seen in FIG. 7, chord 78 is engaged by a selected spool-like engaging area 124 on each of the axles 114 and spool-like engaging area 76 on collar 74 of bridge element 72 such that chord 78 lies in a vertical plan which is parallel to the vertical planes in which arched track members 66, 68 lie. In other words, the spool-like areas 124 on each axle 114 are preferably in alignment with an associated spool-like area 76 on collar 74. The spool-like elements 76, 124 guide chord 78 through carriage assembly 80.

In operation in downhill ski/slalom mode, cross-country handlebar assembly 36 is pivoted out of the way. As a user of machine 10 standing on platform 90 and grasping downhill ski/slalom handlebar assembly 50 forces carriage assembly 80 from its resting position, at the top of arched track members 66, 68, along arched track members 66, 68, chord 68 provides tension to the movement and stretches in response thereto. As more tension chords are added, the resistance is increased and the greater the force required to move carriage assembly back and forth on the downhill ski/slalom track assembly. As described, the preferred embodiment of the present invention is adapted to employ up to four chords, although it will be appreciated that other numbers of chords could be used.

More specifically, as downhill ski/slalom carriage assembly 80 is moved to the left as shown in FIG. 8, chord 78 is drawn with axle 114 of second wheel assembly 112 and around collar 74. The elastomeric nature of tension chord 78 causes it to stretch as it is pulled. In this way, chord 78 provides resistance to movement of carriage assembly 80 from its starting rest position located centrally over the arched track assembly. As the force sufficient to move or sustain carriage assembly 80 in the direction and position shown in FIG. 8 is removed, carriage assembly 80 will be drawn back towards its starting position by the tension of chord 78. As the carriage passes its starting point on its way to the other end of the arched track assembly, the tension chord 78 is engaged by axle 114 of first wheel assembly 110 and collar 74 in the same manner just described, albeit such that the tension of chord 78 resists movement of carriage assembly 80 towards the other end (i.e., the right side of FIG. 8 as shown) of machine 10. Simulation of actual downhill/slalom skiing is enhanced as the user shifts his or her weight on platform 90 thereby causing it to tilt in response to the forces applied thereto. Also, it should be understood that the collar 74 and axles 114 rotate as carriage assembly 80 is moved.

To utilize machine 10 in cross-country mode, downhill ski/slalom carriage assembly 80 may be easily removed by removing chord(s) 78 from their hooked connection to plates 100 and lifting carriage assembly 80 from its mount on arched track members 66, 68. Additionally, as described above, downhill ski/slalom handlebar assembly 50 may be easily removed by releasing pins 54 and lifting handlebar assembly 50 from machine 10.

Use of machine 10 in cross-country skiing mode will be readily appreciated by those familiar with this exercise in view of the foregoing description. Particularly, the user stands facing cross-country handlebar assembly 36 with one of his or her feet on each footpad assembly 18 and with one of his or her hands grasping each of the handlebars 40, 42. Straddling the downhill ski/slalom arched track assembly, the user alternately moves handlebars 40, 42 back and forth while sliding alternately with his or feet on footpad assemblies 18. A computer 140 having a display 142 is located on crossbar 44. Computer 140 monitors the time, the distance traveled while exercising in the cross country ski mode, and the number of repetitions in the cross country ski mode. Utilization of computers for monitoring these and other variables associated with an exercise will be appreciated by those skilled in the art.

From the foregoing it will be seen that this invention is 15 one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An exercise apparatus comprising: a base;

first and second elongate rails on said base;

a first footpad engaged on said first rail and a second footpad engaged on said second rail, whereby said first and second footpads are adapted to move back and forth along the length of their respective rails;

an arched track on said a platform engaged with said arched track, whereby said platform is adapted to move back and forth along said arched track.

2. The exercise apparatus as set forth in claim 1 further comprising first means for resisting movement of said first and said second footpads.

3. The exercise apparatus as set forth in claim 2 further comprising second means for resisting movement of said platform.

* * * * *